US006936112B2

(12) United States Patent
Jansen et al.

(10) Patent No.: US 6,936,112 B2
(45) **Date of Patent: *Aug. 30, 2005**

(54) HEAT EXCHANGER CLEANING PROCESS

(75) Inventors: Bruce Robert Jansen, Wichita, KS (US); Sean Edward Sears, Wichita, KS (US)

(73) Assignee: Refined Technologies, Inc., Wichita, KS (US)

( * ) Notice: Subject to any disclaimer, the term of this patent is extended or adjusted under 35 U.S.C. 154(b) by 196 days.

This patent is subject to a terminal disclaimer.

(21) Appl. No.: 10/304,370

(22) Filed: Nov. 26, 2002

(65) Prior Publication Data

US 2004/0102351 A1 May 27, 2004

(51) Int. Cl.[7] ..... B08B 9/00

(52) U.S. Cl. ..... 134/19; 134/22.1; 134/22.11; 134/22.12; 134/22.14; 134/22.15; 134/22.18; 134/22.19; 134/26; 134/27; 134/30; 134/31; 134/34; 134/35; 134/36; 134/37

(58) Field of Search ..... 134/19, 22.1, 22.11, 134/22.12, 22.14, 22.15, 22.18, 22.19, 26, 27, 30, 31, 34–37

(56) References Cited

U.S. PATENT DOCUMENTS

| | | | | | |
|---|---|---|---|---|---|
| 3,084,076 | A | * | 4/1963 | Loucks | 134/22.1 |
| 4,464,189 | A | * | 8/1984 | Tedder | 62/628 |
| 5,356,482 | A | | 10/1994 | Mehta et al. | 134/22.1 |
| 5,389,156 | A | * | 2/1995 | Mehta et al. | 134/10 |
| 5,425,814 | A | | 6/1995 | Krajicek et al. | 134/22.1 |
| 6,017,492 | A | * | 1/2000 | Hashimoto | 422/27 |
| 6,283,133 | B1 | | 9/2001 | Furuta et al. | 134/22.1 |
| 2004/0102351 | A1 | * | 5/2004 | Jansen et al. | 510/407 |

* cited by examiner

*Primary Examiner*—Sharidan Carrillo
(74) *Attorney, Agent, or Firm*—Shook, Hardy & Bacon L.L.P.

(57) ABSTRACT

Disclosed is a novel process for cleaning and restoring the operating efficiency of organic liquid chemical exchangers in a safe and effective manner and in a very short period of time, without a need to disassemble the equipment and without the need to rinse contaminate from the equipment after cleaning. Used is a formulation of monocyclic saturated terpene mixed with a non-ionic surfactant package specifically suited to oil rinsing. The terpene-based chemical is injected into organically contaminated exchangers using a novel process involving high-pressure steam to form a very effective cleaning vapor.

18 Claims, 7 Drawing Sheets

HEAT EXCHANGER CLEANING PROCESS

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

This invention relates to a process for cleaning the metal surfaces of organically contaminated heat transfer equipment in the petroleum and petrochemical industries to quickly, safely, and economically.

The manufacture of chemicals and petroleum products in the field of this invention consumes enormous amounts of energy. One major refiner—Exxon Mobil—estimates that it expends $190 million dollars in energy per month to operate its refineries and chemical facilities. See The Lamp, Exxon Mobil, Winter 2002. Exxon Mobil production constitutes approximately 10.6% of the United States production capability. Accordingly, one would estimate that more than $1.7 billion dollars of energy is consumed per month in producing these organic products in the petroleum refining industry.

Much of this consumption is due solely to the fouling of system components. The petroleum products and chemicals produced in this field naturally tend to deposit on contact surfaces, causing the equipment to operate sub-optimally. This tendency to deposit exacerbates an already difficult situation. As an example, in an article published in Chemical Engineering Progress, a heat exchanger fouling rate of 0.35 yr-1 was used which when applied to a particular piece of equipment may cause an annual efficiency penalty of 30%. O'Donnell, Barna, Gosling, Chemical Engineering Progress, June 2001. These figures are consistent with the values published by the Tubular Exchanger Manufacturers Association (TEMA) for exchanger fouling resistance. Considering this 30% penalty, if petroleum refining and chemical processing equipment is not cleaned periodically, the resulting cost caused by energy losses attributable to fouling could exceed $500 million. FIG. 1 illustrates how fouling (the result of contaminate deposition on exchanger tube walls) affects the heat exchange coefficient for an exchanger over time. As the heat transfer coefficient decays, more energy must be consumed to accomplish the same fluid heating through the exchanger.

Industry has recognized this problem. An article by O'Donnell, Barna and Gosling describes a method used to compute an optimal cleaning cycle. Industry benchmarks such as the "Solomon Index" rate companies on their ability to optimize their processes. All companies have established an energy reduction and process optimization program. However, prior to this invention, no realistic alternative was available for cleaning heat exchange equipment without stopping the process for a substantial amount of time, subjecting the equipment to metal deteriorating chemistry and deleterious thermal cycles. For example, petroleum refiners use crude preheat exchangers to increase the temperature of crude oil entering distillation towers. These exchangers operate serially with the tower so that if the exchangers are removed from service, the crude feed stops, shutting down the facility. Depending on the nature of the crude, condition of associated equipment, operating temperatures and flow rate, exchangers can foul at a rate of approximately 0.35 Btu/hr Fft$^2$ per year. Typically, refiners will continue to operate these exchangers—despite a 30% annual reduction in efficiency—until the plant is shut down for major maintenance because the cost to shut down the facility and clean the exchangers is too great. Using prior art procedures, exchangers would be removed from service for 3 to 5 days for cleaning. During the prior art procedures, exchangers are subjected to corrosive chemicals, abrasive procedures and large thermal excursions, all of which may damage the equipment or make it impossible to reassemble. Five days of crude unit shutdown may cause a facility to irreversibly lose more than $10 million in revenue. Historically, using prior art practices, this loss in revenue was more costly than the savings provided from cleaning. Thus, a decision was generally made to continue to operate the fouled, inefficient exchangers until efficiency drops so low as to make cleaning cost-effective. If the refinery were able to clean the exchangers more quickly, this decision would be reversed and a great amount of money saved. Before the present invention, however, this was not a possibility.

Other problems with the prior art systems are environmental in nature. The inefficiency caused by fouling causes the emissions of carbon dioxide, sulfur dioxide, nitrogen oxide and other gases to be increased. Thus, a cleaning regimen that improves efficiency also serves to reduce the amount of noxious emissions. The prior art methods also produce large quantities of hazardous waste. These methods typically use water circulation procedures where vessels are completely filled with water and cleaning chemistry. After cleaning, the water tainted with dangerous impurities must be specially treated. A typical refinery turnaround using this kind of water-circulation cleaning procedure will produce approximately 500,000 gallons of hazardous material that must be disposed of at high cost to the refinery while creating a potential ecological nuisance. Likewise, another prior art procedure of blasting solid contaminant from the exchanger using high pressure water also produces large quantities of solid hazardous waste that must be specially treated.

The present invention overcomes these disadvantages in the prior art methods by injecting a cleaning agent into high-pressure steam, and then introducing the steam and cleaning agent, which includes terpenes, into a vented exchanger. Terpenes have been used in refineries before. A liquid-steam method using terpenes is disclosed in U.S. Pat. No. 5,356,482 ("the '482"). The methods disclosed in the '482, however, are much different than those here. The '482 discloses the use of terpenes for removing dangerous and explosive gases from refinery vessels—not for cleaning the metal surfaces inside the exchanger for the purpose of improving heat transfer properties—as with the present invention. The '482 methods are also different in that they involve either the circulation of condensed fluid, or the injection of cleaner into a water circulation. These methods further require the vessel to be sealed under pressure and to cool—a technique that has been known to occasionally cause catastrophic collapse. Unlike the '482 methods, rinsing condensation is not required. Thus, there is no need to reduce the temperature of the vessel to create the necessary condensation. Further, the present invention does not use a microemulsion of cleaning chemical, or rely on mechanical rinsing. Rather, the present invention uses a fully concentrated solution of chemical agent in the vapor form to accomplish the cleaning. Another important difference is that the process of the present invention occurs in a fully vented exchanger. This eliminates any possibility of catastrophic collapse.

SUMMARY OF THE INVENTION

The present invention is a method of cleaning a contaminated vessel, comprising the steps of (i) providing a steam source; (ii) providing a surfactant source; (iii) providing an organic solvent source; (iv) delivering steam from said steam source to said vessel; (v) introducing the organic solvent from the organic solvent source into the steam delivered; (vi) introducing a surfactant from said surfactant source into the steam delivered; (vii) removing vaporous effluent from said vessel; and (viii) removing contaminant from said vessel without the use of hydro-blasting.

More specifically, the process involves taking the exchanger (or exchangers) to be cleaned out of service by blocking it in, injecting a terpene and a surfactant package into high-pressure steam, and introducing the steam and chemistry mixture into the equipment to be cleaned. The cleaner is particularly well suited to cleaning large surface areas with relatively little cleaning fluid. The equipment includes a system of pumps, T-fittings and injector nozzles needed to vaporize and accurately control the volumetric ratios of chemical vapor and steam. The cleaner injected into the steam ideally includes a formulation including a monocyclic saturated terpene mixed with a non-ionic surfactant package.

The process may be used to clean (i) the shell and tube sides of one exchanger at once, (ii) the shell and tube sides of two exchangers at once, (iii) one side of one exchanger, or (iv) one side of one exchanger simultaneously with one side of a second exchanger.

BRIEF DESCRIPTION OF THE DRAWING

The present invention is described in detail below with reference to the attached drawing figures, wherein.

DETAILED DESCRIPTION OF THE INVENTION

The present invention solves the problems present in the prior art methods.

Figure 1:
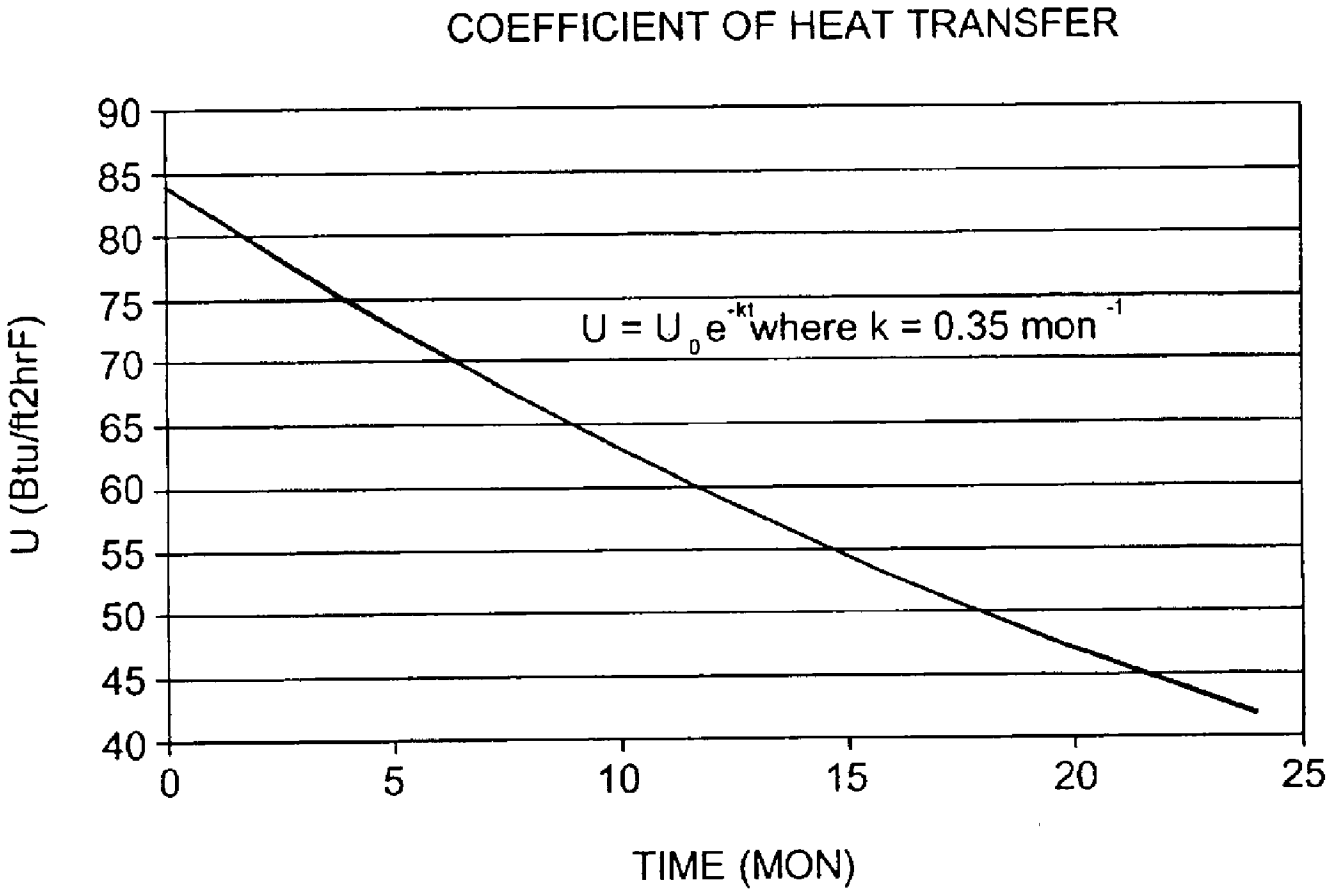
FIG. 1 is a graph showing how fouling affects the heat transfer coefficient for a heat exchanger over time.
Figure 2:
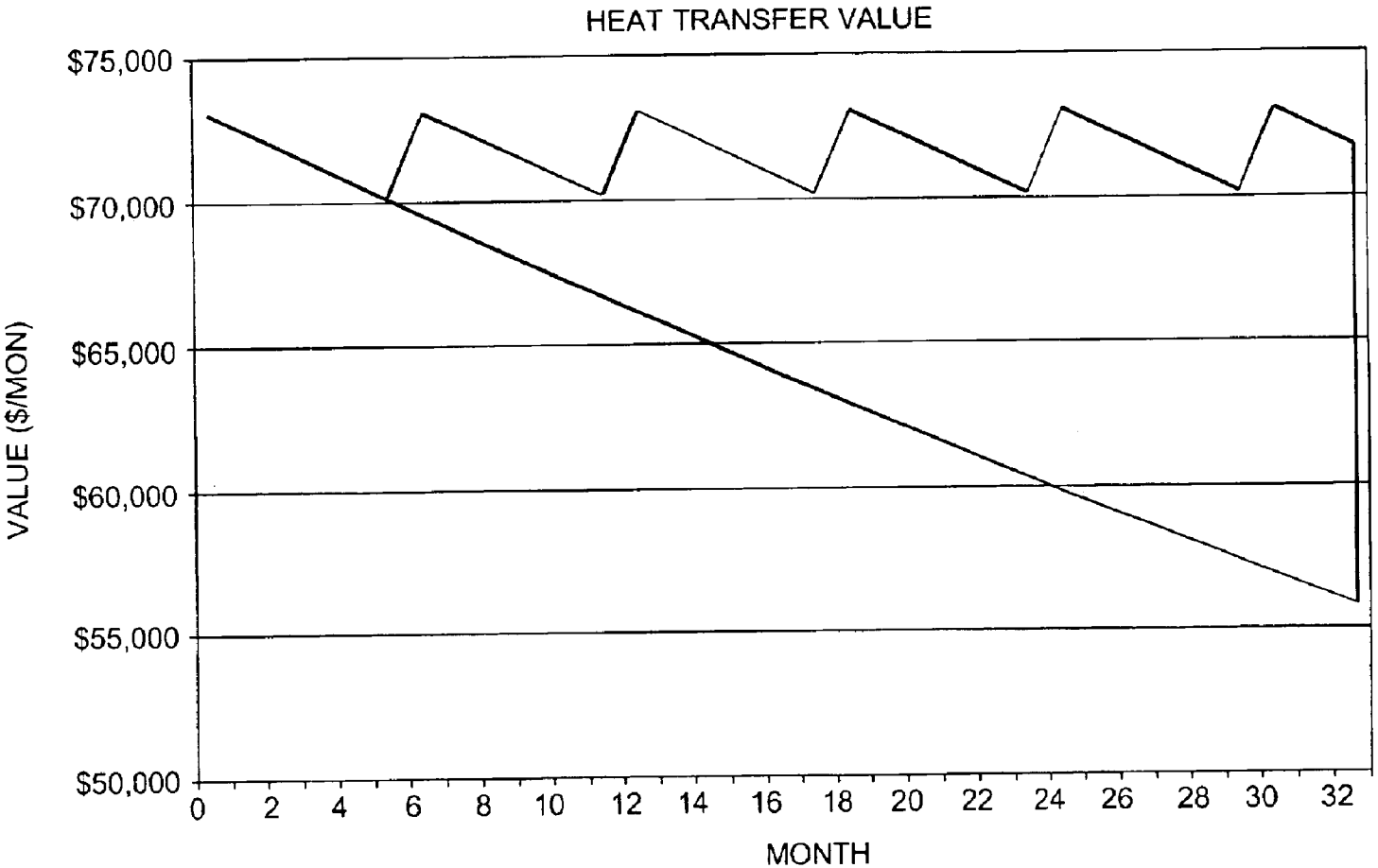
FIG. 2 is a graph showing how refinery operating expense is reduced when a regular maintenance program using the disclosed process is established—the area below a curve computed using a regular cleaning regimen and above the curve without a cleaning regimen.
Figure 4:
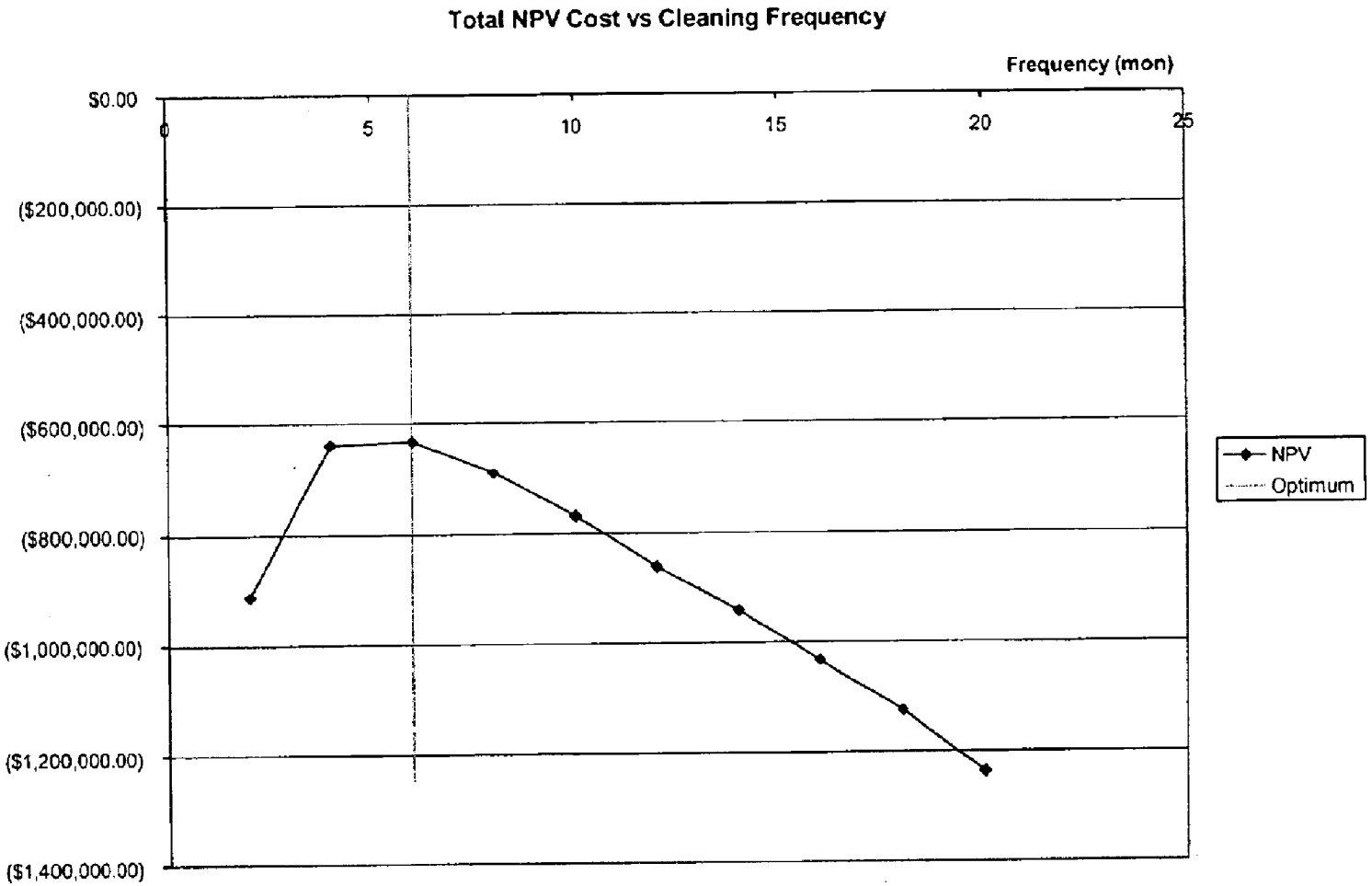
FIG. 4 is a graph comparing the cost of cleaning to the loss due to inefficiency due to not cleaning.

First, by enabling the exchangers to be cleaned more regularly, the resulting unfouled exchangers operate more efficiently, with less heat input. Thus, operating expense is reduced. FIG. 2 shows how operating expense is reduced when a regular maintenance program using the disclosed process is established—the area below a curve computed using a regular cleaning regimen and above the curve without a cleaning regimen. A basic net present value calculation can be used to determine a most optimal cleaning cycle. A curve that identifies a 6 month period as the optimal cleaning interval when comparing cost to clean versus loss in efficiency is shown in FIG. 4. This interval is much shorter than before possible with the prior art methods in which delays of 24 months are typical.

Regular cleaning is possible because the present invention enables the exchangers to be cleaned much more quickly than with the prior art methods. Because the exchangers are cleaned much more quickly, the refinery is able to boost efficiency by defouling while minimizing downtime. The invention does not require equipment disassembly, so equipment requiring cleaning can be cleaned without having to remove the equipment from a feed stream. The invention does not utilize corrosive chemicals or abrasive techniques to work effectively so that equipment will not suffer unpredictable damage during the cleaning process. Using the disclosed invention, the aforementioned crude preheat exchangers can be cleaned without disconnection from the feed train in 2 to 4 hours. During the cleaning process the tube bundles are not removed and the temperature of the exchangers remains elevated. In fact, the elevated temperature of the equipment serves to aid the cleaning process.

The efficiency and effectiveness of the disclosed invention enables completely new operating paradigms. Individual pieces of equipment in a feed stream foul at different rates. Therefore, chemical producers achieve the greatest efficiency gain for the least cleaning expense when targeted equipment is cleaned. With the prior art methods, cleaning required entire plants of equipment to be completely shut down for cleaning and maintenance. After shut down, it is found that some equipment is quite fouled and other equipment is relatively clean. Nevertheless, because the plant is shut down anyway, all the equipment is cleaned—including equipment that is relatively clean. The disclosed invention, however, allows the most fouled (or capacity constraining) equipment to be cleaned on a more frequent basis without necessarily cleaning other less-fouled equipment. Preheat crude exchangers are installed serially in the distillation crude system. There may be as many as 60 exchangers aligned in series so that each exchanger feeds the next. The exchangers foul at different rates, so that at any point one or two exchangers affect the performance of the entire feed train. The invention of the present invention allows one of these most-fouled exchangers to be cleaned while the other exchangers remain in service during the 2 to 4 hour cleaning process. Thus, cleaning time and resources are not wasted on the relatively-clean exchangers. Because the plant does not have to be shut down, operating efficiency of the facility is dramatically increased.

Figure 7:
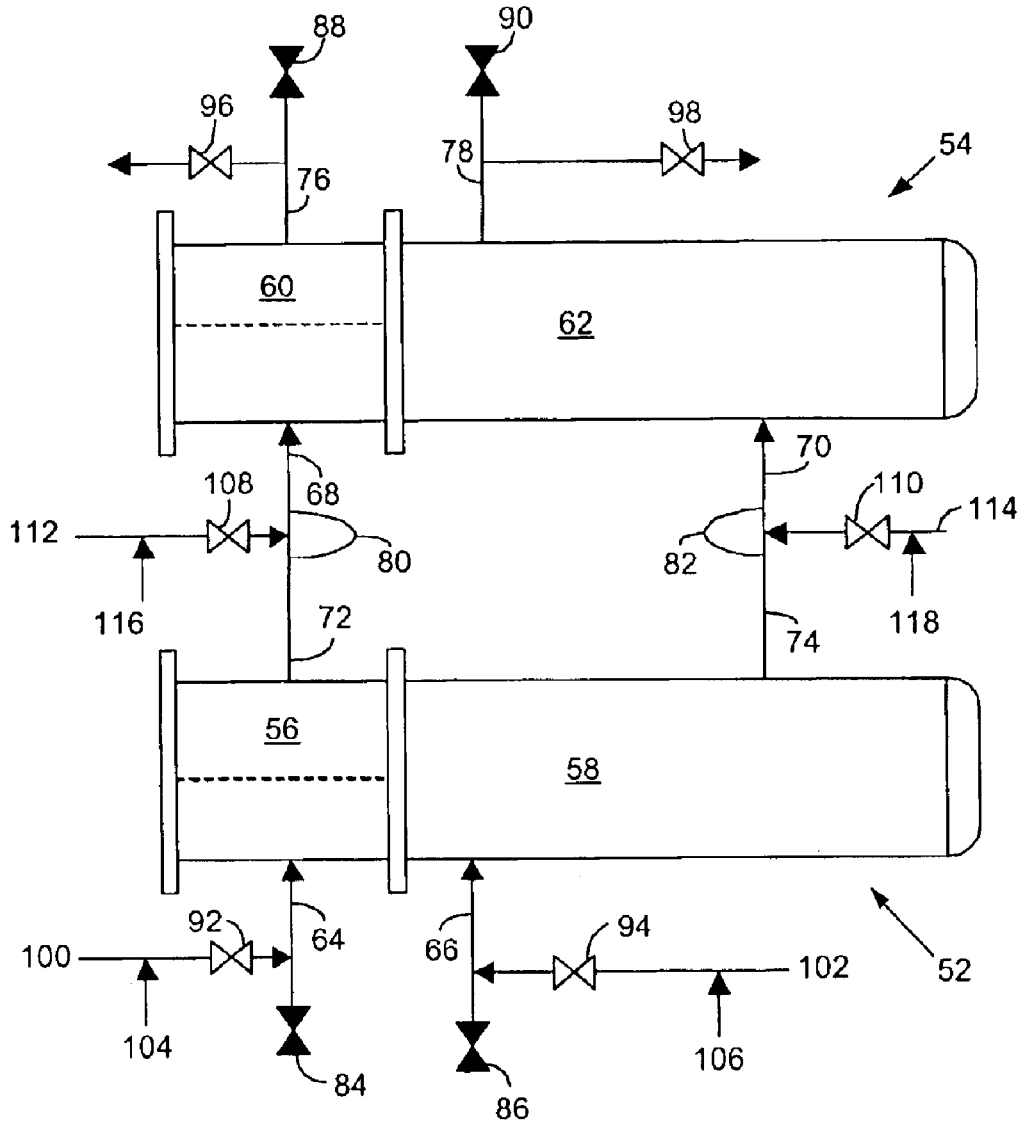
FIG. 7 is a schematic diagram showing the administration of the cleaning process of the present invention in cleaning two exchangers at once.

These technologies also enable two different exchangers to be cleaned in series, as can be seen in FIG. 7. As shown in the figure, both sides of two heat exchangers may be cleaned at the same time. Like the selective cleaning of a single exchanger as discussed above, selectively cleaning the two most-fouled exchangers in a series reduces resources wasted in cleaning the other relatively clean exchangers, thus increasing the operating efficiency of the facility.

The process of the present invention also allows for cleaning one side of an exchanger at a time. Exchangers each have two operating sides, with one side often fouling at a faster rate than the other. The process of the present invention allows the user to clean only the most-fouled side of an exchanger. The other side of the exchanger is able to remain in service.

Figure 3:
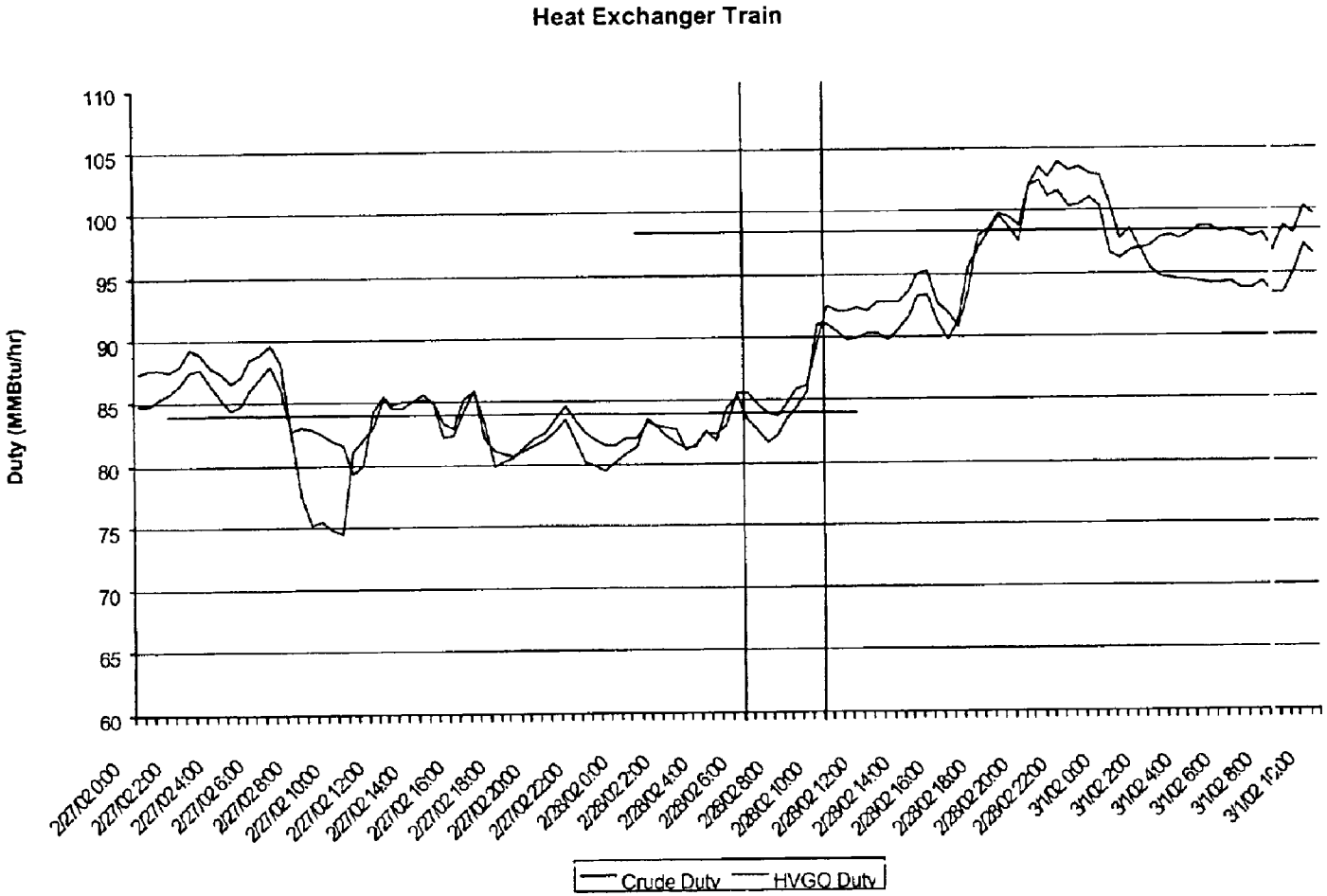
FIG. 3 is a graph comparing the performance of uncleaned versus cleaned exchangers on the same system.

It is also possible to simultaneously clean single sides of two different exchangers in series using the present invention. For example, the shell side of one heat exchanger may be cleaned at the same time as the shell side of another heat exchanger in the series while the tube sides of these exchangers are not cleaned. It is also possible to clean two tube sides of two different exchangers in series and not the shell sides. FIG. 3 charts the effects of these cleaning methods on a bank of 8 exchangers, where only the tube sides of two exchangers were cleaned. As can be seen from the figure, cleaning the tube sides of two different exchangers in series greatly improves overall operating efficiency.

In addition to improving overall efficiency, the present invention is also more environmentally friendly. Again, before the present invention, refineries would continue to operate heavily-fouled equipment in order to avoid the expense of a complete shut-down. The selective cleaning methods of the present invention avoid this dilemma—by enabling more frequent cleanings. Because the equipment is cleaned more often, it operates more efficiently. This reduces the amount of heat/energy required to operate the refinery. The generation of heat/energy required to operate the refinery creates the emissions of toxins such as carbon dioxide, sulfur dioxide, nitrogen oxide and other gases. A reduction in energy consumption of 30% could reduce the total emissions of these toxic gases by 6%. Furthermore, the process of the present invention does not require circulation or rinsing. Instead, by-products of the present invention may be processed as regular chemical feed by the refiner since they contain a preponderance of feed material. Therefore, because no water circulation procedures are necessary, no hazardous waste is produced that must be specially treated.

In addition to protecting the environment, the disclosed process also protects refinery workers from hazardous working conditions. Prior to this invention, workers were required to disassemble heavy equipment and then clean it by hydro-blasting. Workers would sometimes be crushed or otherwise harmed by the heavy equipment involved. Additionally, these workers would potentially be exposed to the dangerous chemicals used.

An additional benefit of the process of the present invention is its ability to clean large equipment using a volume of cleaning agent equivalent to only 1–5% of the volume of the vessel. Also, the time needed to perform the cleaning process is dramatically less than current cleaning processes in the industry. By cleaning with less chemical, more thoroughly, and in a shorter period of time, the disclosed process significantly improves cleaning efficiency while eliminating the need for dangerous disassembly of equipment.

The present invention accomplishes the above described benefits using a naturally occuring organic solvent as the cleaning agent. The cleaning agent is injected directly into high-pressure steam lines already present in the refinery's system. Once injected, the cleaning agent is vaporized, and allowed to clean all surfaces inside the vessel in a very short period of time. The cleaning agent is also unique because it utilizes a surfactant package that improves the detergency (solvency strength) of the product allowing it to be more oil-soluble. This enables the users of the process to "rinse" using the refinery's hydrocarbon process stream rather than the water rinse process used in prior art methods.

This is accomplished using a cleaning agent having two ingredients. The first is a terpene. The term "terpenes" traditionally applied to cyclic hydrocarbons having structures with empirical formula $C_{10}H_{16}$ which occur in the essential oils of plants. Knowledge of the chemistry of the terpene field has developed and compounds related both chemically and biogenetically to the $C_{10}H_{16}$ carbons have been identified. Some natural products have been synthesized and other synthetic compounds resemble known terpene structures. Consequently, the term "terpenes" may now be understood to include not only the numerous $C_{10}H_{16}$ hydrocarbons, but also their hydrogenated derivatives and other hydrocarbons possessing similar fundamental chemical structures. These hydrocarbons may be acyclic or cyclic, simple or complex, and of natural or synthetic origin. The cyclic terpene hydrocarbons may be classified as monocyclic, bicyclic, or tricyclic. Many of their carbon skeletons have been shown to consist of multiples of the isoprene nucleus, $C_5H_8$.

Generally, the terpene selected could be acyclic, bicyclic, or tricyclic. Examples of acyclic terpenes that might be used are geraniolene, myrcene, dihydromycene, ocimene, and allo-ocimene. Examples of monocyclic terpenes that might be used are ρ-menthane; carvomethene, methene, dihydroterpinolene; dihydrodipentene; α-terpinene; γ-terpinene; α-phellandrene; pseudolimonene; limonene; d-limonene; 1-limonene; d,1-limonene; isolimonene; terpinolene; isoterpinolene; β-phellandrene; β-terpinene; cyclogeraniolane; pyronane; α-cyclogeraniolene; β-cyclogeraniolene; γ-cyclogeraniolene; methyl-γ-pyronene; 1-ethyl-5 5-dimethyl-1,3-cyclohexadiene; 2-ethyl-6,6-dimethyl-1,3-cyclohexadiene; 2-ρ-menthene 1(7)-ρ-methadiene; 3,8-ρ-menthene; 2,4-ρ-menthadiene; 2,5-ρ-menthadiene; 1(7),4(8)-ρ-methadiene; 3,8-ρ-menthadiene; 1,2,3,5-tetramethyl-1-3-cyclohexadiene; 1,2,4,6-tetramethyl-1,3-cyclohexadiene; 1,6,6-trimethylcyclohexene and 1,1-dimethylcyclohexane. Examples bicyclic terpenes that might be used are norsabinane; northujene; 5-isopropylbicyclohex-2-ene; thujane; β-thujene; α-thujene; sabinene; 3,7-thujadiene; norcarane; 2-norcarene; 3-norcarene; 2-4-norcaradiene; carane; 2-carene; 3-carene; β-carene; nonpinane; 2-norpinene; apopinane; apopinene; orthodene; norpadiene; homopinene; pinane; 2-pinene; 3-pinene; β-pinene; verbenene; homoverbanene; 4-methylene-2-pinene; norcamphane; apocamphane; campane; α-fenchane; α-fenchene; sartenane; santane; norcamphene; camphenilane; fenchane; isocamphane; β-fenchane; camphene; β-fenchane; 2-norbornene; apobornylene; bornylene; 2,7,7-trimethyl-2-norbornene; santene; 1,2,3,-trimethyl-2-norbornene; isocamphodiene; camphenilene; isofenchene and 2,5,-trimethyl-2-norbornene.

The terpene normally used, and most preferred as the first ingredient in the cleaning agent of the present invention is a monocyclic saturated terpene that is rich in para-menthane ($C_{10}H_{20}$). Para-menthane has a molecular weight of 140.268. This active ingredient includes both the cis- and trans-isomers. Common and approved synonyms for para-menthane include: 1-methyl-4-(1-methylethyl)-cyclohexane and 1-isopropyl-4-methylcyclohexane. Para-menthane is all natural, readily biodegradable by EPA methods, and non-toxic by OSHA standards. Monocyclic saturated terpenes, however, are not the only compounds that may be used as the active ingredient of the cleaning agent. Other naturally occuring terpenes, such as (i) monocyclic unsaturated isoprenoids such as d-limonene ($C_{10}H_{16}$), (ii) bi-cyclic pine terpenes such as -pinene & -pinene, or (iii) any combination of monocyclic and bi-cyclic terpenes could also be used.

A second ingredient in the cleaning agent is an additive. The additive of the present invention is a non-ionic surfactant package which enhances detergency, wetting, oil solubility, and oil rinsing. The first major constituent of the surfactant package includes a linear alcohol ethoxylate ($C_{12}$–$C_{15}$) with an ethoxylated propoxylated end cap. This linear alcohol ethoxylate greatly enhances the detergency or cleaning power of the cleaning agent formulation. Linear alcohol ethoxylates are also more environmentally friendly than more traditional surfactants. They exhibit good biodegradation, and aquatic toxicity properties. Another major constituent of the cleaning agent surfactant package is a fatty alkanolamide primarily consisting of amides and tall oil fatty N,N-bis(hydroxyethyl) This fatty alkanolamide primarily aids in oil rinsing, oil solubility, and wetting. The combination in the proper ratios of these two classes of surfactants achieves the desired enhancements of the cleaning agent formulation. The following non-ionic surfactants with an HLB range of 6.0–10.5 are also acceptable as an additive package but not limited to (i) nonylphenol polyethoxylates, (ii) straight Chain linear alcohol ethoxylates, (iii) linear alcohol ethoxylates with block copolymers of ethylene and propylene oxide, (iv) oleamide DEA, or (v) diethanolamine. Of course, one skilled in the art would recognize that other additives could be used which would still fall within the scope of the invention.

The formulation of the cleaning agent of the present invention is effective at any of the following composition ranges by using a combination of the acceptable chemistries from above:

| Component | Range (by weight) |
|---|---|
| Terpene | 50%–95% |
| Additive Package | 5%–50% |

The formulation of the cleaning agent of the present invention has been found to be most effective when in the following ranges:

| Component | Range (by weight) |
|---|---|
| Terpene | 85%–88% |
| Additive Package | 12%–15% |

Figure 6:
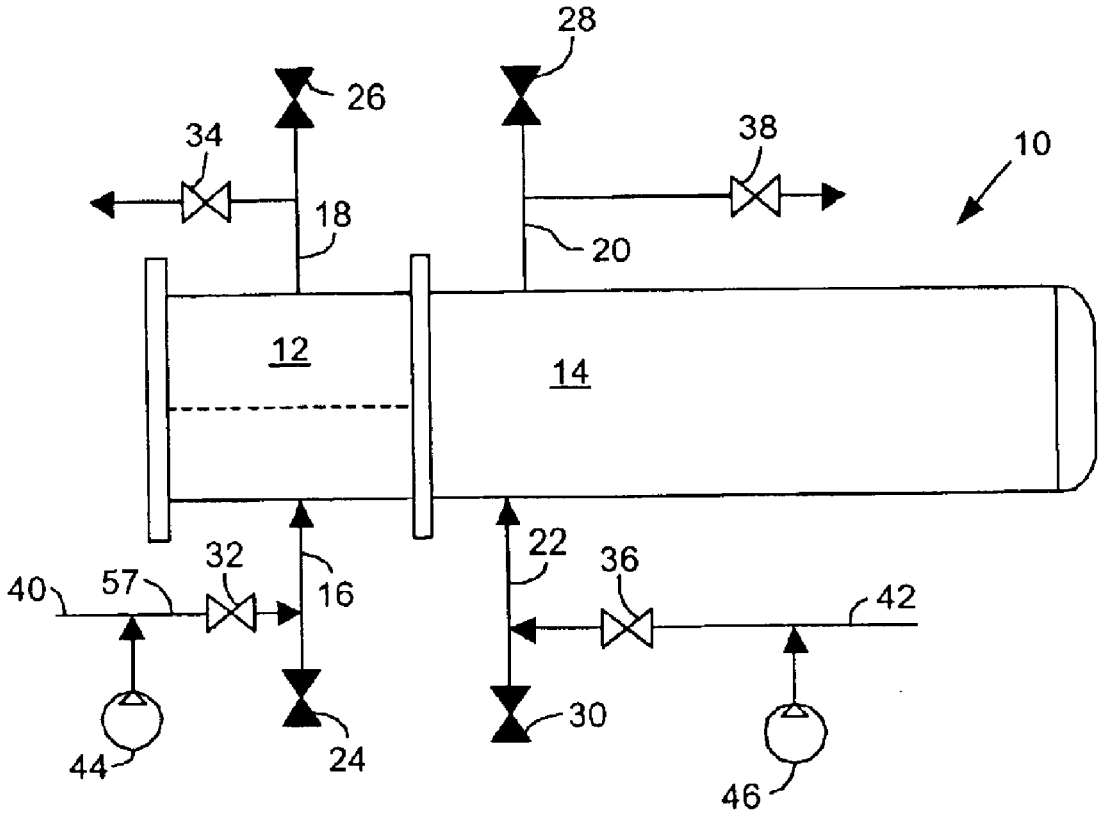
FIG. 6 is a schematic diagram showing the administration of the cleaning process of the present invention in a single shell-and-tube exchanger.

Calculating a ratio based the percentages immediately above, we see that the ratio by weight of the additive surfactants to organic solvents (Terpene) of said cleaning agent should be between 0.136 and 0.176 in order to obtain the best results. It is, however, still within the scope of the invention to use ratios outside the 0.136–0.176 range. The combination of the unique cleaning agent formulation is used according to the following procedures. First, the side or sides of the exchanger desired to be cleaned must be blocked in and evacuated. The exchanger is blocked in by closing off incoming and outgoing fluid valves or by inserting a solid plate (also called "blinding") between the flange faces at interconnecting flanges. FIG. 6 shows how the exchanger may be blocked in using feed valves. Referring to the figure, a typical heat exchanger 10 has a tube side 12 and a shell side 14. Tube side 12 has a feed in 16 and a feed out 18. The flow of fluids in the tube side is in the opposite direction of the flow of fluids in the shell side. Thus, the feed in 20 and feed out 22 on the shell side 14 are reversed in orientation to feeds 16 and 18 on the tube side 12. A tube-side ingoing fluid valve 24 allows the flow of processing fluids into the exchanger when open and a tube-side outgoing valve 26 allows flow out. Similarly, a shell side feed in valve 28 and feed out valve 30 allow flow through the shell side when open. In order to block in the exchanger, valves 24, 26, 28, and 30 are closed. This stops the flow of any processing fluids, blocking the exchanger in. The fluids remaining in the now-blocked-in exchanger are then removed from the exchanger by simple draining.

Once tube and shell sides of the exchanger have been drained and blocked in, the source of stream and venting systems are tapped into the exchanger. Referring again to FIG. 6, each of feeds 16, 18, 20, and 22 have bleeder connections at 32, 34, 36, and 38, respectively. Bleeder connections 32, 34, 36, and 38 enable the user to gain fluid access to exchanger 10 after it is blocked in so that steam may be introduced and then vented.

Steam is tapped into the exchanger using bleeder connections 32 (associated with the tube side in-feed 16) and 36 (associated with the shell side out-feed 22). A first source of steam 40 may usually be tapped into in-feed 16 by simply removing a cap (not pictured) that exists on most bleeder connections. This same procedure is also used to attach a second source of steam 42 to the shell side out-feed 22 through bleeder connection 36. First and second sources of steam, 40 and 42 respectively, are normally obtained from preexisting steam lines in the plant. The lines selected should have steam temperatures of at least 330 degrees Fahrenheit, and are attached to bleeders 32 and 36 in a manner well known to those skilled in the art. Ideally, the line temperatures should be between about 350 to 450 degrees Fahrenheit. The typical 150 psi refinery steam line will work effectively, however, super-heated 40 psi steam lines, which deliver steam at temperatures in excess of 400 degrees Fahrenheit, may be used as well. The injected steam increases internal temperatures within the exchanger.

A first source of cleaning agent 44, which is to be used later on in the process, Is tapped into steam line 40 upstream of the bleeder connection 32. The introduction of cleaning agent is made possible by joining source of steam 40 with cleaner source 44.

Figure 5:
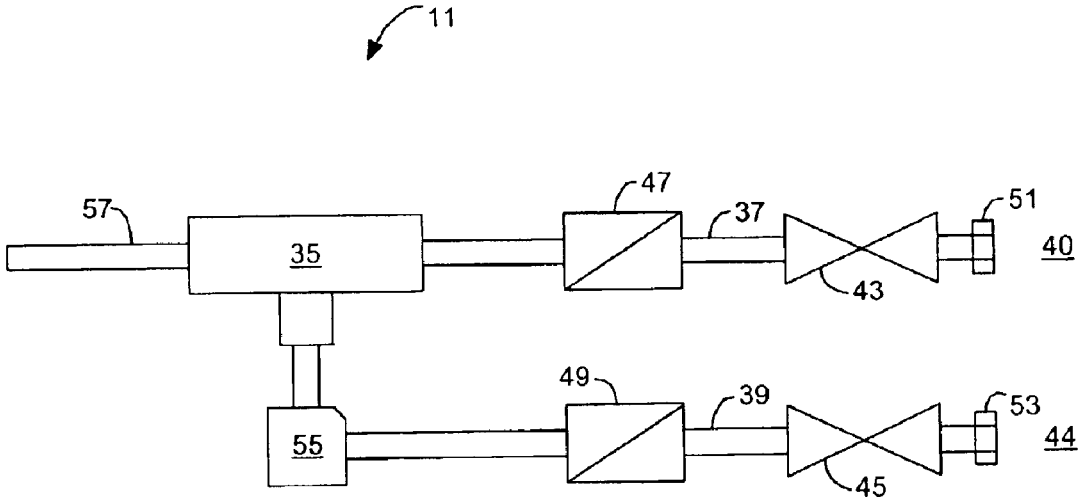
FIG. 5 is a schematic diagram showing the injection equipment of the present invention.

The administration of both steam and cleaner are accomplished using an administrator 11. The details regarding administrator 11 of the present invention are shown in FIG. 5. FIG. 5 discloses that steam 40 and cleaner 44 sources joined at a T-junction 35. Such T-junctions are standard plumbing, and acceptable embodiments are readily available to one skilled in the art. The refinery steam hose (not shown) selected as steam source 40 for use in the cleaning process is attached to steam conduit using a standard connector 51. Conduit 37 transmits the steam under pressure to a first side of junction 35. Between steam source 40 and junction 35 on conduit 37, a gate valve 43 serves to either open or shut off the source of steam 40 after the hose is attached. Immediately downstream, a check valve 47 allows flow in the downstream direction only. This prevents back flow of cleaning chemical or effluent into steam source. Interposed on conduit 39 between cleaner source 44 and junction 35 are gate valve 45 and check valve 49. Gate valve 45 is used to either allow or shut off the flow of cleaner from source 44. Check valve 49 allows flow in the downstream only to prevent the back flow of steam into the cleaner container. A standard elbow 55 is used to converge conduit 37 and 39 into junction 35. After steam and cleaner conduits, 37 and 39 respectively, meet up at junction 35, their collective flows are converged into a common line 57, shown in FIG. 5. Common line 57 is tapped into bleeder connection 32, shown in FIG. 6. This valved-T-junction arrangement enables the user to optionally: (i) introduce neither steam, nor cleaner; (ii) introduce only steam; or (iii) introduce steam and vaporized cleaner through bleeder connection 32 into in-feed 16, into the tube side 12 of exchanger 10. Cleaner is administered using a pneumatic barrel pump (not pictured) which is attached to a connector 53 on cleaner conduit 39. The cleaner is initially in liquid form, however, when it reaches T-fitting 35, it is immediately vaporized and is administered to the exchanger in vaporous form.

A cleaning-agent administrator identical to the one discussed in detail above is used to introduce steam from source 42 and cleaner from source 46 through bleeder connection 36 into out-feed line 22 into the shell side 14 of exchanger 10. Though not pictured in order to avoid being duplicitous, it should be understood that the arrangement and operation of such an administrator would be identical to the one disclosed in FIG. 5.

After being delivered by the administrator, the steam (or steam plus cleaner) introduced into tube side 12 and shell side 14 of the exchanger is then vented from the exchanger through bleeder connections 34 (associated with tube side out-feed 18) and 38 (associated with shell side in-feed 20). Bleeders 34 and 38 are fluidly connected to the ventilation system of the refinery using techniques and equipment known to those skilled in the art. This connection should be consistent with a predetermined plan devised for dealing with the vented effluent. It is important that this particular plan complies with all state and local regulations. This can be done by any number of methods. Some examples of methods that have been used successfully are: (i) allowing the vapor to condense through the overhead circuit and tie into the flare so that it may be burned, or (ii) opening an overhead vent to the atmosphere. Of course, one skilled in the art will realize that other methods of managing the effluent are possible and are to be considered within the scope of the present invention. It is also important to note that the invention is not limited in scope to the use of bleeders (such as 32, 34, 36, and 38) in order to gain fluid access to the exchanger. In fact, any potential opening to the exchanger may be used. For example, in some exchangers process gauge connections are used instead of bleeders. Sometimes a combination of bleeders and process gauges might be used. Other kinds of exchanger openings giving access to the exchanger may be used as well. Thus, though the embodiments disclosed in this application show the use of bleeder connections to tap into the exchanger, the particular device used to gain vaporous access to the exchanger is not to be considered an essential or limiting feature of the present invention.

Once the steam and venting systems have been tapped in, the exchanger is then pre-heated by injecting only steam into both sides of the exchanger. Both sides of the exchanger are continually vented throughout the preheating process. Again, the steam delivered should have temperatures of at least about 330 degrees Fahrenheit. The injected steam increases internal temperatures within the exchanger. These internal temperatures should be increased until they exceed about 225 degrees Fahrenheit. Since this steam preheating and the subsequent injection process are both carried out at atmospheric pressure (substantially) while venting the exchanger, it is important for the production facility to have a plan in effect for managing the vaporous, vented effluent as mentioned earlier. The preheating process will cause the development of some condensed water mixed with contaminants at the bottom of the exchanger. Therefore, in order to remove this mixture after the exchanger has reached the 225 degree target, the steam is temporarily turned off so that the mixture may be drained from both sides of the exchanger. Because draining the exchanger may cause it to cool slightly, the steam should then be reactivated until the exchanger reaches 225 degrees.

Once the exchanger has been preheated as so, it is time to inject the cleaner into the already running steam. The amount of cleaner necessary is dependent on the total enclosed volume of each side of the exchanger, and the nature and volume of contaminate. Satisfactory results have been obtained using 55 gallons of cleaner per 100 to 1000 cubic feet of exchanger volume (from 0.055 to 0.55 gallons per cubic foot of exchanger volume). Ideally in terms of performance, no less than 55 gallons should be used per 200 cubic feet of exchanger volume (no less than 0.275 gallons per cubic foot of exchanger volume). Most commonly, a 0.275 ratio has been used to minimize cost, while at the same time maintaining sufficient cleaning power. However, if the amount of contamination is greater than typical, this ratio should be increased to higher levels to accommodate. The volume of the exchanger can be calculated by multiplying the cross sectional area of the exchanger by the length. Typically, the shell side of an exchanger accounts for 60% of the total exchanger volume, whereas the tube side accounts for only 40%. Thus, about 60% of the cleaning chemical is injected into the shell side of the exchanger using cleaner source 44, and 40% injected into the tube side using cleaner source 46.

Cleaner from each of sources 44 and 46 is delivered using administrators like the one shown in FIG. 5. The pneumatic pumps (not shown) used for the procedure require approximately 9 minutes per 55-gallon drum to inject the cleaning agent. The steam will vaporize the cleaning agent and carry it into the equipment.

Once the vaporized cleaning chemical enters into the exchanger, two distinct cleaning actions take place simultaneously. First, the vaporous cleaning agent solublizes the light end hydrocarbons (benzene, $H_2S$, LEL, etc.) that are present in the inside of the exchanger. Once solubized by the vaporous cleaning agent, these light end materials are carried out of the exchanger in vaporous form through the vent. The vapors coming out of the vent should be handled in accord with the plan set forth in advance. As already discussed, possible plans include, but are not limited to, (i) allowing the vapor to condense through the overhead circuit and then tie into the flare to be burned, or (ii) opening an overhead vent to the atmosphere.

The second cleaning action is more gradual. Due to the partial pressures of cleaning agent, some of its vapors will re-condense into liquid upon contacting the cooler metal surfaces inside the exchanger. These metal surfaces are usually heavily coated with petroleum residues and processing fluids. The kinetic energy generated when portions of the cleaning agent's vapors condense onto these metal surfaces (the transformation from a vapor phase to a liquid phase releases energy), along with the tremendous solvency strength of the formulation, allow the petroleum contaminants to be dissolved away from the metal surfaces inside the exchanger. Once removed, these contaminants become detached from the metal and drip to the drain at the bottom of the exchanger. Some contaminants, however, remain bound to the metal surfaces inside the exchanger. These more stubborn contaminants, though still clinging to metal, are saturated by and subjected to the strong detergency, wetting, oil solubility, and oil rinsing properties of the surfactant. This causes them to be loosened and easily soluble into oil. Thus, they are easily rinsed away by the flow of ordinary processing fluids after the exchanger is returned to service.

After about one hour, the injection of cleaner into the exchanger is stopped. Steam, however, continues to be injected.

Following the injection phase, the equipment is allowed to dwell for about one more hour at elevated temperature while steam is continually injected into the equipment. This dwell cycle allows the contaminants to further dissolve via continuous revaporization of the condensed cleaner.

After the dwell cycle, the steam injection is stopped, and the drain is opened to a post-processing or containment system. When the exchanger is drained, liquid effluent comprising contaminate and residual cleaning agent is removed. The liquid effluent may be removed by carrying it out of the exchanger directly to slop tanks. Once in the slop tanks, the effluent is easily post processed. The post processing is made easy because the cleaning agent is all natural, and thus, biodegradable. The effluent might also be passed directly through the post processing equipment in the refinery, where it will be refined in the normal course of production. Because the cleaning agent included in the drained effluent is a naturally occurring hydrocarbon which does not contain any chelating agents, phosphates, silicates, or any chemicals that would cause problems with treatment facilities, it may be easily re-refined without harming the facility's equipment.

Following the drain process the equipment is resealed, blinds are removed, and valves are opened. After the exchanger has been repacked (filled with processing fluids), the exchanger is then returned to service. At this time, the contaminants still clinging to metal within the exchanger have been made loose and more oil soluble by the additives/surfactants. Thus, they are rinsed away by the flow of ordinary processing fluids in the ordinary course of operation after the exchanger has been returned to service. The cleaned exchanger, its contaminants removed, will now operate at maximum efficiency.

These same general principles may be employed in the simultaneous cleaning of two heat exchangers as well. FIG. 7 shows a first exchanger 52 and a second exchanger 54 connected in series, as would be common with a train of exchangers in a refinery. In such an arrangement, tube out-feed 72 of tube side 56 of first exchanger 52 is fluidly connected to the in-feed 68 of the tube side 60 of second exchanger 54. Likewise, in-feed 74 of shell side 58 of first exchanger 52 is fluidly connected to out-feed 70 of second exchanger 54. It is common for the shell sides and tube sides of a pair of exchangers to be linked together as shown in FIG. 7 during ordinary course of operation. Thus, it is usually not necessary to connect the feeds 72 and 74 to feeds 68 and 70 because they will already be hooked up.

The process of cleaning two exchangers at once is accomplished in much the same manner as describe for the one-exchanger process. First, the side or sides of the exchanger desired to be cleaned must be blocked in and evacuated. The two exchangers 52, and 54 are blocked in by closing the tube side ingoing fluid valve 84 and shell side outgoing fluid valve 86 of first exchanger 52, and then closing off the outgoing tube side fluid valve 88 and ingoing shell side fluid valves on second exchanger 54. Thus, tube sides 56 and 60, being fluidly connected, are completely blocked in as well as fluidly connected shell sides 58 and 62. The fluids remaining in both exchangers are then drained.

Once both exchangers have been blocked in and drained, access to the exchanger is gained by tapping in at bleeder connections 92, 94, 96, 98, 108, and 110. Connections 92, 94, 108 and 110 are used to tap in steam and cleaner in the exact same way as disclosed for the single-exchanger method represented in FIG. 6. The steam sources are all drawn from existing stream lines in the refinery having steam temperatures of at least about 330 degrees Fahrenheit—ideally between about 350 to 450 degrees Fahrenheit—just like with the one-exchanger method. It will be observed that the FIG. 7 process requires two additional sources of steam, 112 and 114, and two additional sources of cleaner, 116 and 118. Steam source 112 is tapped into bleeder 108. The steam introduced mixes with vaporous effluent coming out of the out-feed 72 of the tube side 56 of first exchanger 52 before passing into the in-feed 68 of the tube side 60 of the second exchanger 54. Similarly, steam source 114 is tapped into bleeder 110. This steam mixes with the effluent coming out of shell side in-feed 74. Then it passes into out-feed 70 of shell side 62 of second exchanger 54.

The administration of both steam and cleaner in this two-exchanger cleaning method is accomplished using administrators with T-junctions (not shown, but all just like the one shown in FIG. 5) to mix cleaner from sources 104, 106, 116, and 118 with steam from sources 100, 102, 112, and 114 respectively. The administrators are tapped in to bleeder connections 92, 94, 108, and 110. As with the one-exchanger process, these administrators enable the user to optionally: (i) introduce neither steam, nor cleaner; (ii) introduce only steam; or (iii) introduce steam and vaporized cleaner into feed lines 64 and 66 and connecting lines 80 and 82.

There are two reasons that the fresh steam and cleaner are injected into connecting lines 80 and 82. This is because (i) the temperature of the vaporous effluent coming out of the first exchanger will have dropped to below ideal temperatures, and (ii) the amount of cleaner present in the second exchanger will have dissipated from the time in which it was introduced into the first exchanger. The fresh steam and cleaner injected into lines 80 and 82 will raise temperatures and cleaner concentrations to the point that the second exchanger may be effectively cleaned.

As with the one-exchanger method shown in FIG. 6, the FIG. 7 two-exchanger method vents the vaporous effluent. With the two-exchanger method, effluent is vented through bleeder connections 96 and 98 into the ventilation system of the refinery which has been prepared in advance. Again, there must be a predetermined plan in place for dealing with the vented effluent. As with the earlier method, this can be done by (i) allowing the vapor to condense through the overhead circuit and tie into the flare so that it may be burned, (ii) opening an overhead vent to the atmosphere, or managing the effluent in any other way known to those skilled in the art. Though bleeder connections are used in this embodiment, certainly process gauge openings or any other acceptable opening on the exchanger may be used.

Once the steam and venting systems have been tapped in, the exchanger is pre-heated by injecting only steam at about 330 degrees Fahrenheit minimum into bleeder connections 92, 94, 108 and 110. This will preheat tube sides 56 and 60 and shell sides 58 and 62. The steam is continually vented through bleeders 96 and 98 throughout the preheating process. This preheating should continue until the internal temperatures of both exchangers reaches exceed about 225 degrees Fahrenheit. Once this temperature is reached, all the steam sources (100, 102, 112, and 114) are temporarily turned off so that any water (due to condensation) and contaminants at the floor of exchangers 54 and 58 may be drained. Because all the steam sources are shut off during draining, the exchangers will cool. In order to bring them back above the minimum temperature (225 degrees) the steam sources should be reactivated.

Once the reactivated steam brings the internal temperatures of both exchangers to above at least 225 degrees, cleaner from sources 104, 106, 116, and 118 is injected into already running steam sources 100, 102, 112, and 114. In terms of its chemical make-up, the cleaner used here is the same as described for use in the one-exchanger cleaning method depicted in FIG. 6. The amount of cleaner necessary, like with the one-exchanger method, is calculated based on the total enclosed volume of each side of each exchanger. Again, the ratio of gallons of cleaner per cubic foot of exchanger may range from 0.055 to 0.55, however, for best results a ratio of no less than 0.275 gallons per cubic foot should be used for typical contamination. This ratio should be slightly increased for greater than average contamination. Because the shell side of an exchanger accounts for 60% of the total exchanger volume, whereas the tube side accounts for only 40%, about 60% of the cleaning chemical should be injected into the shell sides 56 and 60, and only 40% injected into tube sides 58 and 62. Of the 60% of total cleaner designated to shell sides 56 and 60, half of this total is injected from source 104 through bleeder 92 and the other half is injected from source 116 through bleeder 108. Likewise, of the 60% total cleaner designated for the shell sides, half is injected from source 106 through bleeder 94 and the other half is injected from source 118 through bleeder 110.

Cleaner from each of sources 104, 106, 116, and 118 is delivered into administrators like the one shown in FIG. 5 into bleeder connections 92, 94, 108, and 110. The steam and vaporized cleaner injected into bleeder 92 enters into tube side 56 of first exchanger 52 at in-feed 64 to begin the cleaning actions therein. The light end hydrocarbons (benzene, $H_2S$, LEL, etc.) are solubized, and exit (along with steam and cleaner) through out-feed 72. This effluent from out-feed 72 mixes with the fresh steam and cleaner from sources 112 and 116 introduced at bleeder 108. This mix is then passed into tube side 60 of second exchanger 60 where it solubizes the light end hydrocarbons and then vents through bleeder 96 according to the predetermined plan for handling the vaporous effluent for that particular facility.

Meanwhile, some of the vaporous cleaning agent will re-condense into liquid upon contacting the cooler metal surfaces inside of tube sides 56 and 60. The terpenes will dissolve much of the contaminant away from the metal. The remaining contaminant will be made more oil soluble by the surfactant package so as to be loosened and easily soluble into oil. This will cause these remaining contaminants to be easily rinsed away by the flow of ordinary processing fluids after the exchanger is returned to service.

The shell sides 58 and 62 are cleaned simultaneously with tube sides 56 and 60—and in exactly the same way. The steam and vaporized cleaner injected into bleeder 94 enters into shell side 58 of first exchanger 58 at in-feed 66. The effluent steam, remaining cleaner, and solubized light end hydrocarbons exit through out-feed 74 and mixes with the fresh steam and cleaner from sources 114 and 118 introduced at bleeder 110. The vaporous mixture is then passed into shell side 62 of second exchanger 60 where it removes the light end hydrocarbons and then vents through bleeder 98. Just like with the tube side procedure, terpenes in the cleaner that condenses on the metal surfaces will dissolve some of the contaminants, and the remaining contaminants will be made more oil-soluble by the surfactants in order to be washed away when the exchanger is returned to service.

After about one hour of running steam and vaporous cleaner through both exchangers, the injection of cleaner into the exchanger is stopped at all four locations (104, 106, 116, 118). Steam, however, continues to be injected—allowing the two exchangers dwell for about one more hour at elevated temperature.

After the one-hour dwell cycle, steam sources 100, 102, 112, and 114 are turned off, and the drains of exchangers 54 and 58 are opened to a post-processing or containment systems. When the exchangers are drained, liquid effluent comprising contaminate and residual cleaning agent is removed to slop tanks for post-processing (or directly through the post-processing equipment in the refinery to be refined in the normal course of production).

Following the drain process, exchangers 52 and 54 are resealed, blinds are removed, and valves are opened to repack the exchanger with processing fluids. After the exchanger has been repacked, the exchanger is then returned to service and the remaining contaminants, now oil soluble are rinsed away by the flow of ordinary processing fluids in the ordinary course of operation. Exchangers 52 and 54, now decontaminated, should operate at maximum efficiency.

These same processes may be used in other ways than the one-exchanger and two-exchanger methods already discussed. The same process may also be used to clean only one side of one exchanger (shell or tube) at a time. This is sometimes advantageous when one side of the exchanger (e.g., tube side) is more contaminated than the other (e.g., shell side). Referring to FIG. 6, this is accomplished in the same way described for the one-exchanger method—except that only half of the exchanger would be cleaned. To do this, one of the tube side 12 or shell side 14 could be cleaned without cleaning the other side. This would be done by closing valves 24 and 26 to block in tube side 12, draining, preheating and cleaning the same as described for the one-exchanger process described above, while shell side remained in service, still transmitting processing fluids. The reverse is true as well. Shell side 14 could be blocked off and cleaned while tube side 12 remained in service.

This same approach may also be applied to clean only one side of two exchangers at once. Referring to FIG. 7, tube sides 56 and 60 may be blocked in (by closing valves 84 and 88) and then cleaned while valves 86 and 90 are left open so that shell sides 58 and 62 remain in service. The reverse is also true. Shell sides 58 and 62 could be blocked in and cleaned while tube sides 56 and 60 remained in service.

It is important to note, that although the examples above suggest the use of multiples sources of steam, and multiple sources of cleaner, that single sources of steam or cleaner could be used. For example, multiple hoses could be drawn from one common source of steam. Cleaner sources could all be drawn from the same source.

The methods of the present invention, as described above enable an exchanger to be cleaned in 2 to 4 hours—an accomplishment that before would have taken 3 to 5 days. Additionally, these methods allow for cleaning without the dangerous disassembly of equipment, and in a more environmentally friendly manner, than was known before.

Thus, there has been shown and described a method for cleaning a vessel in a refinery which fulfills all of the object and advantages sought therefore. Many changes, modifications, variations, and other uses and applications of the subject invention will, however, become apparent to those skilled in the art after considering this specification together with the accompanying figures and claims. The same process, together with ensuing benefits are also applicable to similar equipment in unrelated industries (such as sugar, pulp and paper) where organic contaminants must be removed from heat exchangers or process equipment so as to improve operating efficiencies. All such changes, modifications, variations and other uses and applications which do not depart from the spirit and scope of the invention are deemed to be covered by the invention which is limited only by the claims which follow.

What is claimed is:

1. A method of cleaning a contaminated vessel, comprising the steps of:

providing a steam source;

providing a surfactant source;

providing a organic solvent source comprising a terpene;

delivering steam from said steam source to said vessel;

removing vaporized hydrocarbon contaminants out of said vessel while steam is delivered to the vessel;

introducing said terpene from said organic solvent source into the steam delivered to said vessel during said removing step; and introducing a surfactant from said surfactant source into the steam delivered to the vessel during said removing step.

2. The method of claim 1 including the additional step of preheating the vessel with said steam prior to the introduction of said terpene and said surfactant.

3. The method of claim 1 wherein the surfactant comprises a linear alcohol ethoxylace (C12–C15) with an ethoxylated propoxylated end cap and a fatty alkanolamide.

4. The method of claim 1 wherein said surfactant comprises at least one of nonylphenol polyethoxylate, a straight chain linear alcohol ethoxylate, a linear alcohol ethoxylate with block copolymers of ethylene and propylene oxide, and diethanolamine.

5. The method of claim 1 wherein said terpene is a monocyclic saturated terpene.

6. The method of claim 1 wherein said terpene is a monocyclic unsaturated isoprenoid.

7. The method of claim 1 wherein said terpene is a bi-cyclic pine terpene.

8. The method of claim 1 wherein said terpene comprises a mixture of monocyclic unsaturated isoprenoids.

9. The method of claim 1 wherein said terpene comprises a mixture of bi-cyclic pine terpenes.

10. The method of claim 1 wherein said terpene comprises a mixture of monocyclic unsaturated isoprenoids and bi-cyclic pine terpenes.

11. The method of claim 1 wherein said surfactant and said terpene are introduced into said steam by joining said steam, surfactant, and organic sources.

12. The method of claim 1 wherein said vessel is a heat exchanger.

13. The method of claim 1 said removal of vaporous effluent step further comprises the step of venting said vaporous effluent to the atmosphere.

14. The method of claim 1 wherein said step of removing vaporized hydrocarbon contaminants further comprises the steps of:

venting the vaporized hydrocarbon contaminants to one of a flare and an interconnected vessel.

15. The method of claim 1 including the additional step of draining the vessel.

16. The method of claim 1 wherein said terpene is selected from the group consisting of: geraniolene; myrcene; dihydromycene; ocimene; allo-ocimene; ρ-menthane, carvomethene; methane; dihydroterpinolene; dihydrodipentene; α-terpinene; γ-terpinene; α-phellandrene; pseudolimonene; limonene; d-limonene; 1-limonene; d,1-limonene; isolimonene; terpinolene; isoterpinolene; β-phellandrene; β-terpinene; cyclogeraniolane; pyronane; α-cyclogeraniolene; β-cyclogeraniolene; γ-cyclogeraniolene; methyl-γ-pyronene; 1-ethyl-5 5-dimethyl-1-1,3-cyclohexadiene; 2-ethyl-6,6-dimethyl-1,3-cyclohexadiene; 2-ρ-menthene 1(7)-ρ-methadiene; 3,8-ρ-menthene; 2,4-ρ-menthadiene; 2,5-ρ-menthadiene; 1(7),4(8)-ρ-methadiene; 3,8-ρ-menthadiene; 1,2,3,5-tetramethyl-1-3-cyclohexadiene; 1,2,4,6-tetramethyl-1,3-cyclohexadiene; 1,6,6-trimethylcyclohexene and 1,1-dimethylcyclohexane, norsabinane; northujene; 5-isopropylbicyclohex-2-ene; thujane; β-thujene; α-thujene; sabinene; 3,7-thujadiene; norcarane; 2-norcarene; 3-norcarene; 2-4-norcaradiene; carane; 2-carene; 3-carene; β-carene; nonpinane; 2-norpinene; apopinane; apopinene; orthodene; norpadiene; homopinene; pinane; 2-pinene; 3-pinene; β-pinene; verbenene; homoverbanene; 4-methylene-2-pinene; norcamphane; apocamphane; campane; α-fenchane; α-fenchene; sartenane; santane; norcamphene; camphenilane; fenchane; isocamphane; β-fenchane; camphene; β-fenchane; 2- norbornene; apobornylene; bornylene; 2,7,7-trimethyl-2-norbornene; santene; 1,2,3,-trimethyl-2-norbornene; isocamphodiene; camphenilene; isofenchene; 2,5,-trimethyl-2-norbornene; and any mixtures thereof.

17. The method of claim 5 wherein said terpene is para-menthane.

18. The method of claim 11 wherein said joining is accomplished using a T-fitting.

* * * * *